US006151748A

United States Patent [19]

Earhart, Jr. et al.

[11] Patent Number: 6,151,748

[45] Date of Patent: Nov. 28, 2000

[54] CARPETING AND SURFACE CLEANING APPARATUS

[75] Inventors: Robert E. Earhart, Jr., Thornton; Kenneth F. Halls, Arvada; Grant K. Halls, Boulder, all of Colo.

[73] Assignee: Environmental Cleaning Systems, Inc., Denver, Colo.

[21] Appl. No.: 09/531,928

[22] Filed: Mar. 21, 2000

[51] Int. Cl.[7] ..... G47L 11/34

[52] U.S. Cl. ..... 15/321; 15/322; 239/227

[58] Field of Search ..... 15/320, 321, 322; 239/227

[56] References Cited

U.S. PATENT DOCUMENTS

| | | | |
|---|---|---|---|
| 4,000,538 | 1/1977 | Tissier . | |
| 4,182,001 | 1/1980 | Krause | 15/320 |
| 4,191,589 | 3/1980 | Halls . | |
| 4,219,155 | 8/1980 | Goerss | 15/320 X |
| 4,353,145 | 10/1982 | Woodford . | |
| 4,369,544 | 1/1983 | Parisi . | |
| 4,441,229 | 4/1984 | Monson | 15/320 X |
| 4,692,959 | 9/1987 | Monson | 15/320 |
| 5,133,107 | 7/1992 | MacDonald . | |
| 5,367,740 | 11/1994 | McCray . | |
| 5,463,791 | 11/1995 | Roden | 15/320 |
| 5,587,021 | 12/1996 | Hoersh . | |
| 5,784,754 | 7/1998 | Roden et al. | 15/320 |

FOREIGN PATENT DOCUMENTS

| | | |
|---|---|---|
| 434-907 | 7/1991 | European Pat. Off. . |
| 2535-226 | 10/1982 | France . |
| 1567-181 | 2/1988 | U.S.S.R. . |

*Primary Examiner*—Chris K. Moore
*Attorney, Agent, or Firm*—Thomas W. Hanson

[57] ABSTRACT

A cleaning device for either carpeted or hard surfaces which utilizes pressurized cleaning fluid to clean the surface. The fluid nozzles are arranged on two or more heads which are in turn mounted on two or more arms. The arms rotate about a common axis causing the heads to move in a circular pattern. The heads rotate about their own central axis. The nozzles are angled relative to the surface being cleaned and preferably rotate towards the direction of the fluid jet. Preferably, at least two of the heads counter-rotate. Also preferably, the heads are arranged at somewhat different radial distances from the rotational axis of the arms so that their coverage patterns partially overlap. The combination of the counter rotation and the overlap provides an alternating, or beating, pattern to the angle of incidence of the fluid on the surface being cleaned. The device may alternatively include vacuum nozzles to retrieve the cleaning fluid and may incorporate two sets, one to the front and one to the rear, so that the device may be operated in either direction. Optionally, manual or automatic switching may be used to activate one set of nozzles at a time. Additional rinse nozzles may be used to provide additional rinse fluid immediately adjacent the vacuum nozzles. The rinse nozzles may also be switched with the vacuum nozzles.

20 Claims, 9 Drawing Sheets

CARPETING AND SURFACE CLEANING APPARATUS

FIELD OF THE INVENTION

The present invention relates to cleaning devices for floors and other surfaces, especially such devices which use a pressurized cleaning fluid to effect the cleaning.

BACKGROUND OF THE INVENTION

Carpet cleaning systems of the general configuration of the present invention are well known. The use of a separate base and mobile unit is common as it reduces the weight of the mobile unit which the user must manipulate. Many such systems, however, rely on brushes or fixed cleaning nozzles to do the actual cleaning. The use of fixed nozzles is effective, but limited in that a particular spot on the carpet is typically treated only a single time, by a single nozzle.

A previous patent, U.S. Pat. No. 4,191,589 to Halls et al discloses a mobile unit comprising rotating arms with fixed nozzles positioned at the ends of the arms. That system improves on the fixed nozzle systems in that a particular spot will be addressed many times as the nozzles rotate past. The rotary motion of the arms is imparted by the force of the cleaning fluid exiting the nozzles. As such, the arm rotates in a direction away from the direction of the cleaning fluid jet. One embodiment of the system comprised a single nozzle which pointed in the direction of rotation. Its force then has to be overcome by the force of the remaining jets so that the arm will rotate. That system also incorporates a vacuum pickup at the front edge, supplemental rinse nozzles positioned behind the vacuum pickup, and a base unit comprising the vacuum and pressure pump subsystems. The use of fluid pressure at the nozzles to impart the rotary motion is convenient and advantageous in that the unit can be made much lighter since no mechanical drive train is required. However, the efficiency of the cleaning is compromised. A majority of the jets must move away from the direction of the fluid jet, reducing their effectiveness. The fluid pressure and nozzle angles must be selected so as to impart the desired rotational speed. The arm, and nozzles, are in motion only when cleaning fluid is being emitted. A "spin up" delay is required when the cleaning fluid is activated to allow the arm to attain its rotation speed, During this delay, cleaning ability is compromised, and it may be necessary to hold the unit in a stationary position, wasting cleaning fluid, time, and possibly over exposing the surface to cleaning fluid, leading to saturation.

Windsor Industries Inc., Englewood, CO has reportedly sold a cleaning system in which a motor drive is used to rotate an arm with a set of fixed heads in the direction of the fluid jet. This design overcomes some of the problems of the pressure driven system but still falls short of an ideal system. All of the jets in this system point in the same direction and rotate in the same direction. Further, the coverage pattern is a simple circular one which can lead to skips and striping.

Various types of rotary brush floor cleaners are also well known. These are typically designed for use on hard surfaced floors. While usable on certain short-napped carpets, they are not generally applicable to carpeted surfaces.

There is a need for a cleaning system which utilizes pressurized cleaning fluid applied from a series of rotating nozzles wherein the motion of the nozzles and the pressure and angle of the cleaning fluid jets are not interrelated. The nozzles should travel in a complex pattern such as that provided by rotating heads mounted to a separately rotating arm. Preferably the pressure at which the fluid is emitted and the angle at which it is emitted can be varied without effecting the rotational speed of the supporting arm. Preferably, the nozzles will move in the same direction in which the cleaning jet is emitted, rather than away from it. Ideally, plural heads will be provided which rotate in opposite directions, providing alternating directions for the fluid jet. Ideally, fluid pressure and temperature, rotational speed, and nozzle angle can all be adjusted by the end user of the system, either via a control on the base unit, remote wireless or corded control on the mobile unit, or by interchanging components of the system. Such a system should be usable on a variety of surface including carpeted and hard surfaced floors

SUMMARY OF THE INVENTION

The present invention is directed to an apparatus for cleaning either carpeted or hard surfaces. The apparatus utilizes multiple nozzles on rotating head which are in turn mounted on rotating arms. The rotation of the arms and the heads is mechanically driven, independently of the fluid pressure. In the preferred embodiment, the heads rotate in the direction of the fluid jet and at least two of the heads counter-rotate.

According to the invention there is provided a chassis supporting plural arms, each arm supporting at least one head, each head having at least one nozzle. A fluid supply subsystem provides pressurized cleaning fluid to the nozzles by way of the arms and heads. A mechanical drive system uses a motor to rotate the arms about a common axis and to rotate the heads around their own central axis.

According to an aspect of the invention at least two of the heads are positioned at a different distance from the axis about which the arms rotate, providing a partially overlapping coverage pattern.

According to another aspect of the invention the heads rotate in the direction of the fluid jet and, further, at least two of the heads counter rotate.

Further in accordance with the invention either, or both, of the motor speed and the fluid pressure are variable.

Still further in accordance with the invention, a vacuum subsystem is provided to recover the cleaning fluid. It may use a single set of nozzles at the front end, or may also include a second set at the back end. Where two sets are used, switching may be provided to activate only one set at a time, and this switching may be automatic, dependent on the direction of movement.

Still further in accordance with the invention, rinse nozzles may be provided adjacent the vacuum nozzles to provide additional, possibly clean, fluid. Switching of the nozzles may also be provided and may be automated.

The advantages of such an apparatus are that a pressurized fluid cleaning system is provided in which rotating heads, in combination with rotating arms, provide a complex and more thorough coverage pattern than is possible without the rotating heads. Where the heads counter-rotate, the system provides an alternating pressure pattern which physically beats the surface, and dirt, resulting in more effective cleaning than where a single direction is used. The rotational speeds and fluid pressure are variable, allowing the system to be configured to a wide variety of surfaces and soil conditions.

The above and other features and advantages of the present invention will become more clear from the detailed description of a specific illustrative embodiment thereof, presented below in conjunction with the accompanying drawings.

DETAILED DESCRIPTION OF THE INVENTION

Figure 1:
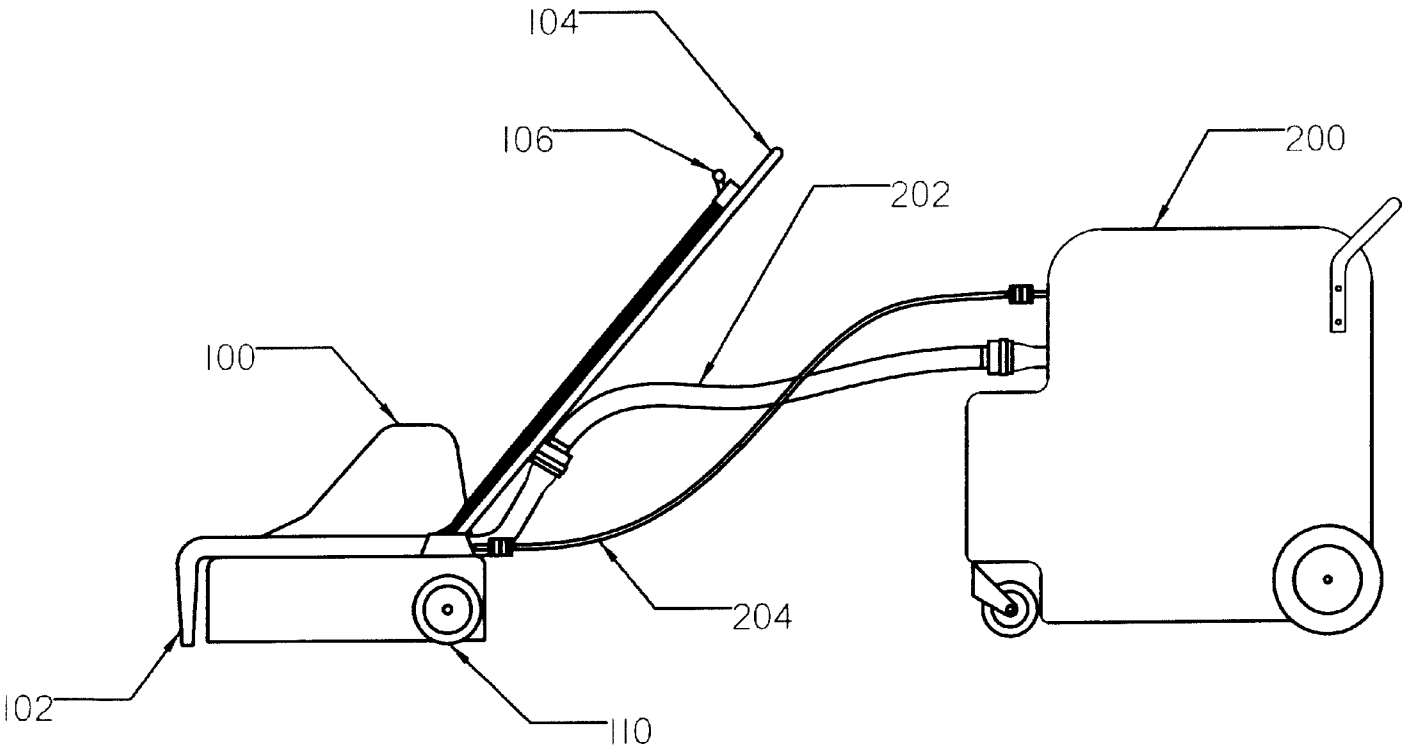
FIG. 1 shows the components of the complete system.

The following discussion focuses on the preferred embodiment of the invention, as a carpet cleaner. However, as will be recognized by those skilled in the art, the disclosed apparatus is applicable to a wide variety of situations in which surface cleaning using a cleaning fluid is desired.

The following is a brief glossary of terms used herein. The supplied definitions are applicable throughout this specification and the claims unless the term is clearly used in another manner.

Arm—generally the rotating portion of the mobile unit which supports the heads. In the preferred embodiment a single unit it used which comprises two opposed arms. Unless clearly used otherwise, "arm" in intended to encompass any structure comprising plural arms extending outward from a single axis.

Base Unit—that portion of the system containing the fluid tanks, pressure pump, optional fluid heater, and vacuum pump. While movable, it typically remains stationary while the mobile unit is used to clean the floor. It will be moved from location to location, or room to room, as necessary to allow the mobile unit to reach the entire area to be cleaned.

Cleaning Fluid—the fluid used by the system to clean the surface. Typically this would be water to which a detergent solution has been added. However, use of clean water, degreasers, solvents, and other cleaning solutions is anticipated. Use of compressed air, or other gas, either with or without another entrained component is also anticipated.

Coverage pattern—the area of the surface to be cleaned which is wetted as the component in question is activated. There are coverage patterns for the nozzles, heads, and the combined arm/head unit. Most typically, coverage pattern refers to the coverage pattern of the nozzles on the head as it rotates about its axis and that axis is rotated about the central shaft as the arm rotates. A second coverage pattern of importance is generated as the central shaft is then linearly translated as the mobile unit is moved.

Fan angle—herein, generally the angular coverage pattern of a jet as it is emitted form the nozzle. Narrow angles provide greater impact and wider angles provide greater coverage, for the same fluid pressure.

Floor—used herein as a generic term to refer to that surface being cleaned by the present invention. While the invention would most frequently be used with carpeted floors, use of the invention with hard surfaced floors, paved surfaces, countertops and various other surfaces is anticipated. The present design can be readily embodied in a smaller handheld unit adapted for use with smaller, or enclosed, areas.

Front, Rear—"Front" refers to the end of the mobile unit furthest from the user. "Rear" is the end nearest the user. In use, the unit is typically pulled toward the user, resulting in the front being the last portion of the unit to pass over the surface being cleaned.

Head—generally one of the rotating heads located at the distal end of the arm.

Jet—generally describes the high pressure stream of cleaning fluid emitted by a nozzle. May also be referred to as a fluid jet.

Mobile Unit—that portion of the system which is moved across the floor by the user to effect the cleaning operation.

Nozzle—generally a short tube terminating in an opening designed to emit a jet of cleaning fluid.

Preferred Embodiment

The disclosed invention is described below with reference to the accompanying figures in which like reference numbers designate like parts. Generally, numbers in the 100's refer components of the disclosed invention. Numbers in the 200's are used to refer to other parts of the system with which the present invention is used, or to objects in the surrounding environment.

The present invention is an improvement to a cleaning system of the type illustrated in FIG. 1. This type of system is typically used for cleaning carpets, but is also applicable to other types of floors, countertops, driveways, parking lots, or almost any other essentially smooth surface. The base unit, 200, is a portable unit which includes supply tanks for the cleaning fluid and additives (if any); a waste recovery tank; a pressure pump; and a vacuum pump. Alternatively, a connection to a supply source, such as a faucet, could be used in place of the supply tank. Injection of a detergent or other additives could be used with either the supply source connection or with a supply tank filled with otherwise clean fluid. The pressure pump provides high pressure cleaning fluid, through hose, 204, to the mobile unit, 100, as is well known in the art. Preferably, the output pressure of the pump is variable. This may be controlled at the base unit or by a wired or wireless remote control on the mobile unit. The cleaning fluid may also be heated with the temperature controlled in a similar manner. The vacuum pump draws air from the mobile unit, through hose, 202, as is also well known in the art. The resultant combination is a self contained system which applies a cleaning fluid to the surface to be cleaned and then recovers the fluid, leaving the surface substantially free of cleaning fluid. The base unit is portable and can be moved from room to room, or to location to location within a larger room, but typically remains stationary while an area is cleaned with the mobile unit. The mobile unit is moved over the surface to be cleaned in order to effect the cleaning. Typically, the mobile unit is pulled backward by the user while cleaning, and then rolled forward for repositioning. The backward movement results in the vacuum nozzles, 102, passing over the cleaned surface immediately after the cleaning nozzles. The rearward and upward pull on the handle, 104, also lifts the rear of the unit slightly, resulting in a transfer of weight to the front of the unit, applying an increased downward force on the vacuum nozzles, increasing their efficiency. Valve, 106, is activated by the user to regulate the flow of cleaning fluid to the cleaning nozzles, and optionally to the auxiliary rinse nozzles, as discussed below. The general configuration of the cleaning system is conventional and is well known in the art. The novel aspects of the present invention relate to the configuration and operation of the mobile unit as discussed below.

Structure

Figure 2:
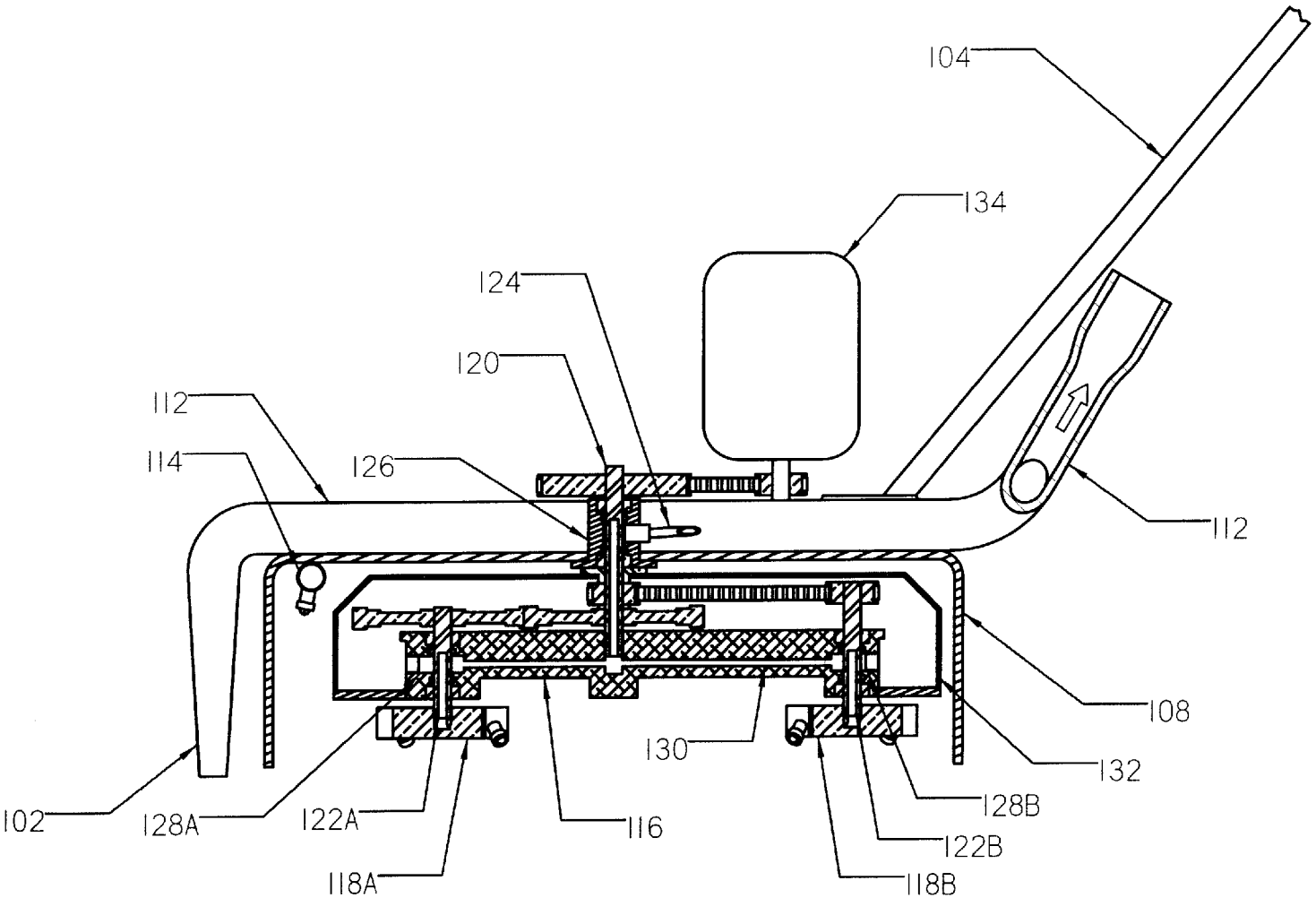
FIG. 2 is a cross section through the mobile unit.
Figure 3:
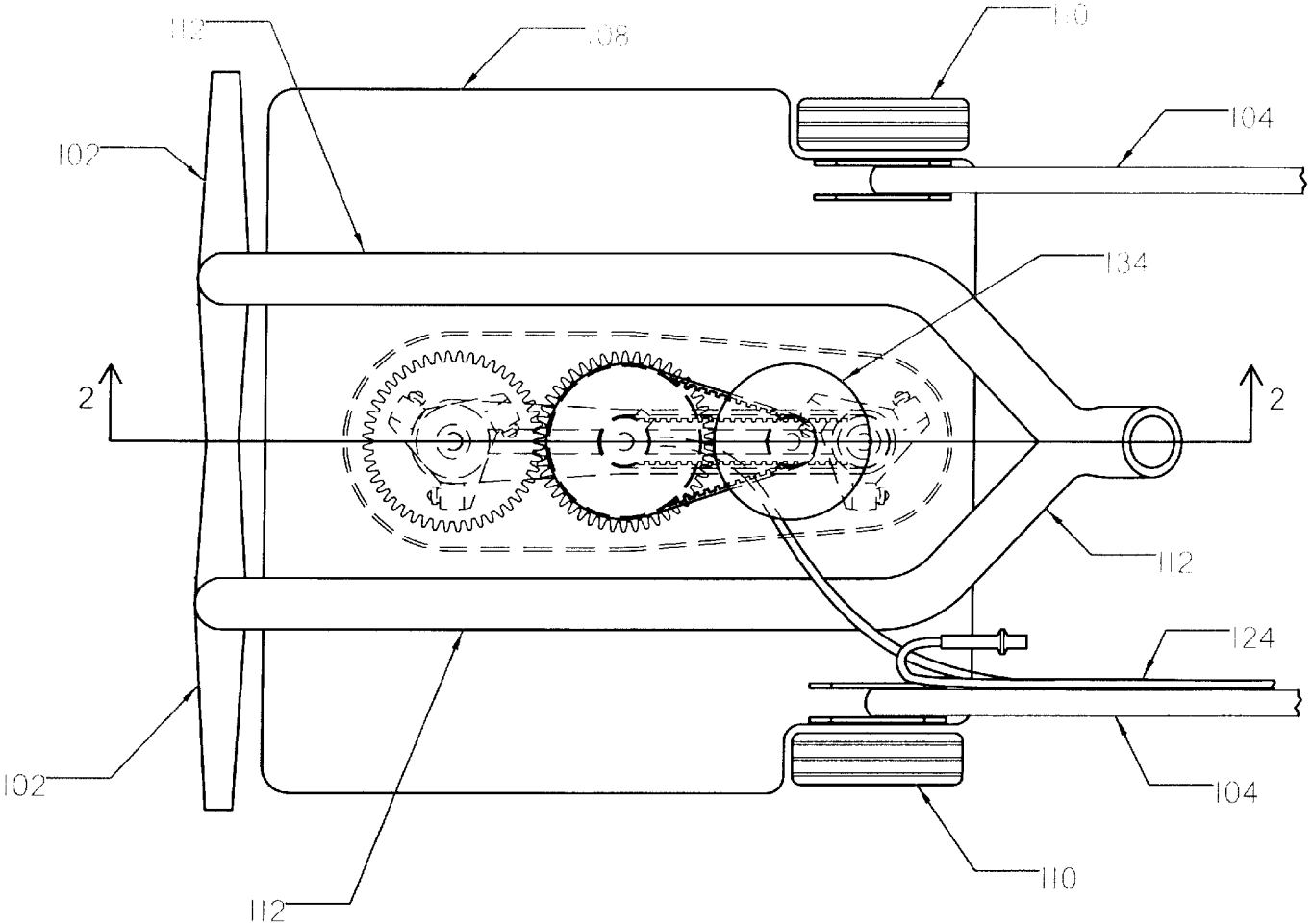
FIG. 3 provides a top view of the mobile unit with the cover removed.
Figure 4:
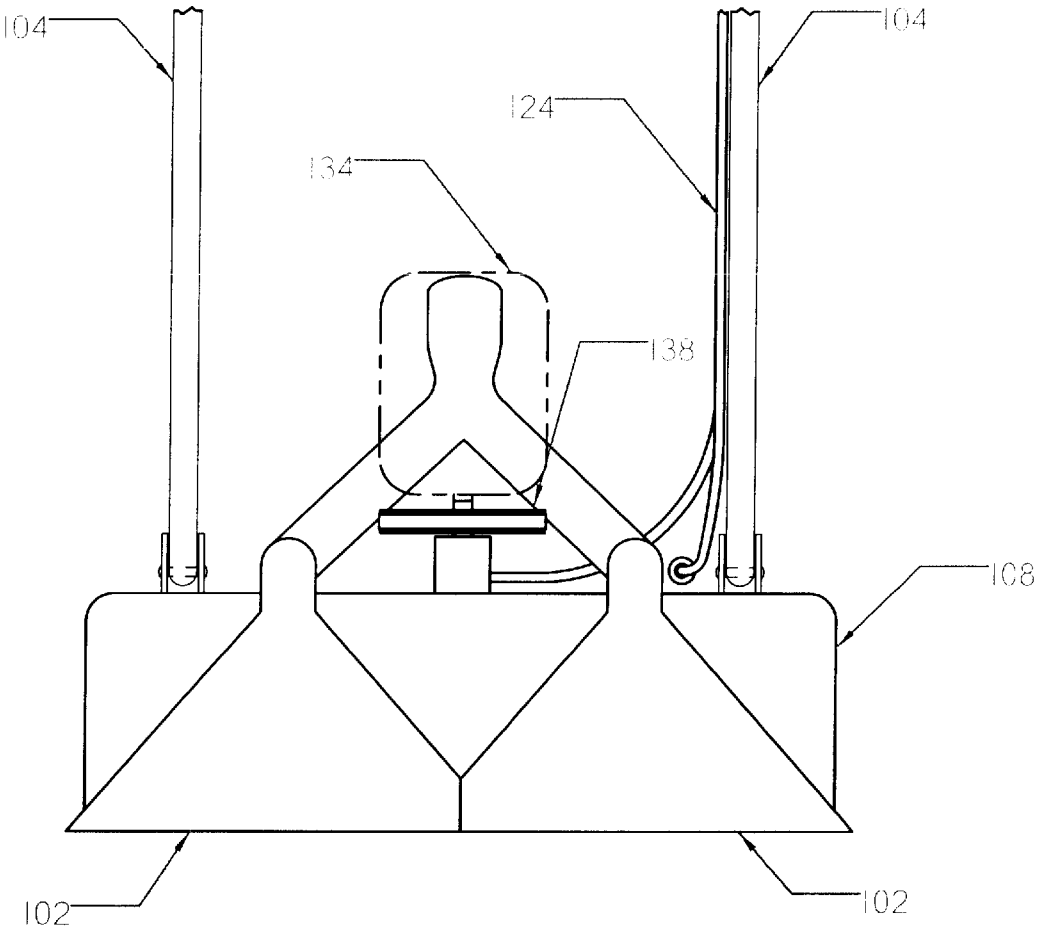
FIG. 4 provides a front view of the mobile unit with the cover removed.

The structure of the mobile unit is shown in more detail in FIGS. 2–4. Chassis, 108, provides the main structure for the unit as well as enclosing and shielding the rotating arms and heads which do the actual cleaning. Wheels, 110, and handle, 104, attach to the chassis in a conventional manner. Vacuum nozzles, 102, are positioned at the front end of the unit and connect to the hose from the base unit via pipes, 112. Optional rinse nozzles, 114, apply extra cleaning fluid to the surface closely adjacent the vacuum nozzles to aid in rinsing the surface. If preferred, the rinse nozzles can be provided clean fluid, such as water, without detergent or other cleaning additives.

Figure 8:
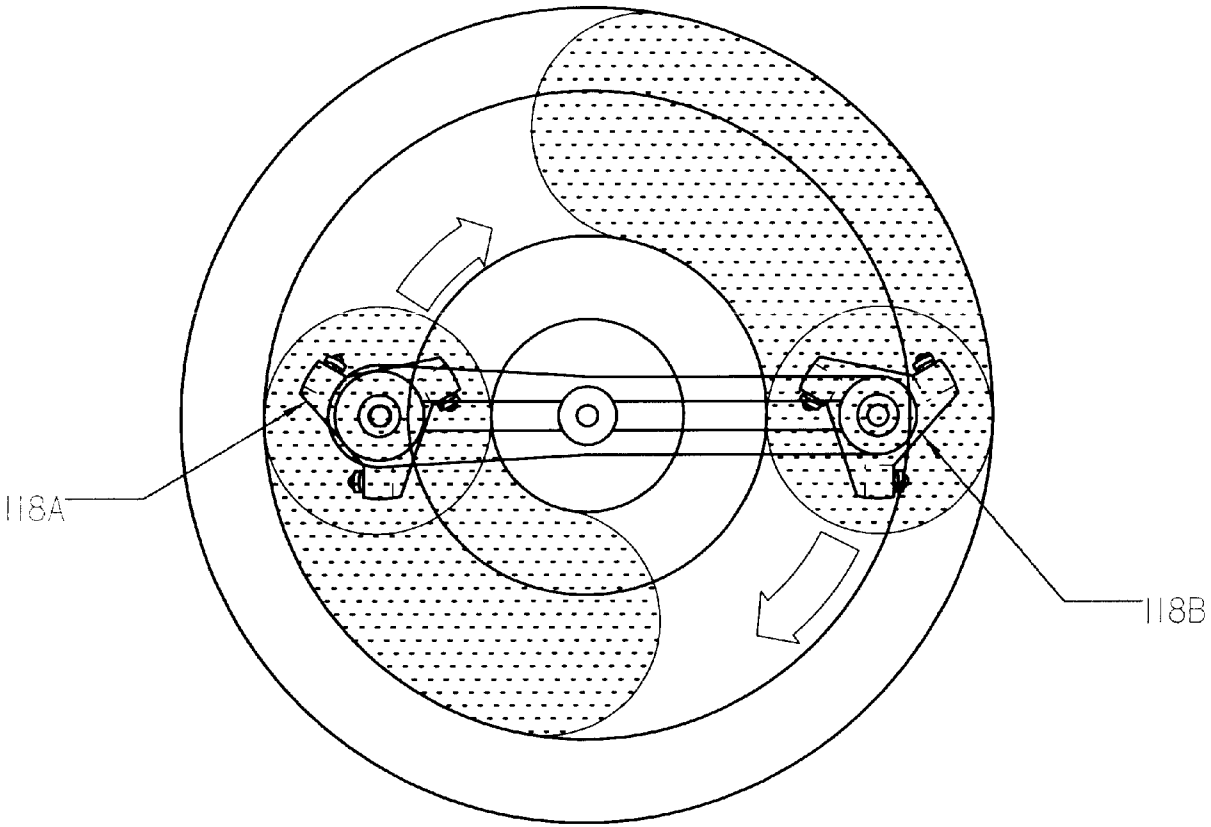
FIG. 8 illustrates the coverage pattern of the heads.

The novel aspect of the present invention is embodied in the configuration and operation of the arm, 116, and heads, 118A&B. The arm rotates around shaft, 120, carrying the heads in a circular path. The heads also rotate around their respective shafts, 122A&B, generating a circular spray pattern. Both the arm and the heads rotate substantially parallel to the surface being cleaned. Heads 118A and 118B are at different radial distances from the shaft, 120. This configuration results in a partially overlapping coverage pattern as shown in FIG. 8. When combined with the linear movement of the mobile unit the result is a complex coverage pattern of the surface being cleaned. While beneficial in that it prevents streaking or striping, the overlapping pattern is not required as the linear movement of the unit will result in both heads covering all parts of the surface. Rotary union, 126, transfers pressurized cleaning fluid from supply hose, 124, to the internal passage of hollow shaft, 120. The passage then transmits the fluid to passage, 130, which runs lengthwise through the arm, supplying the fluid to rotary unions, 128A&B. These unions then transfer the cleaning fluid to the internal passages of hollow shafts, 122A&B. These shafts then supply the fluid to the heads 118A&B, for application to the surface to be cleaned. Clearly, an external hose, or other means, is equivalent to the internal channel. Similarly, other rotary fluid coupling devices are equivalent to the rotary unions. Cover, 132, encloses the arm and drive components (discussed below) to minimize their exposure to the cleaning fluid and dirt, and to provide an increased margin of safety for the operator.

In the preferred embodiment, a single structure, 116, is used to provide two opposed arms to carry the cleaning heads. It is anticipated that three or more arms, and heads, could also be used. This would allow for increased flexibility in selecting radial distances to the heads, for different coverage patterns, and would allow rotation rates, nozzle angles, rotation speeds, and other characteristics to be altered and intermixed with greater variety.

Figure 10:
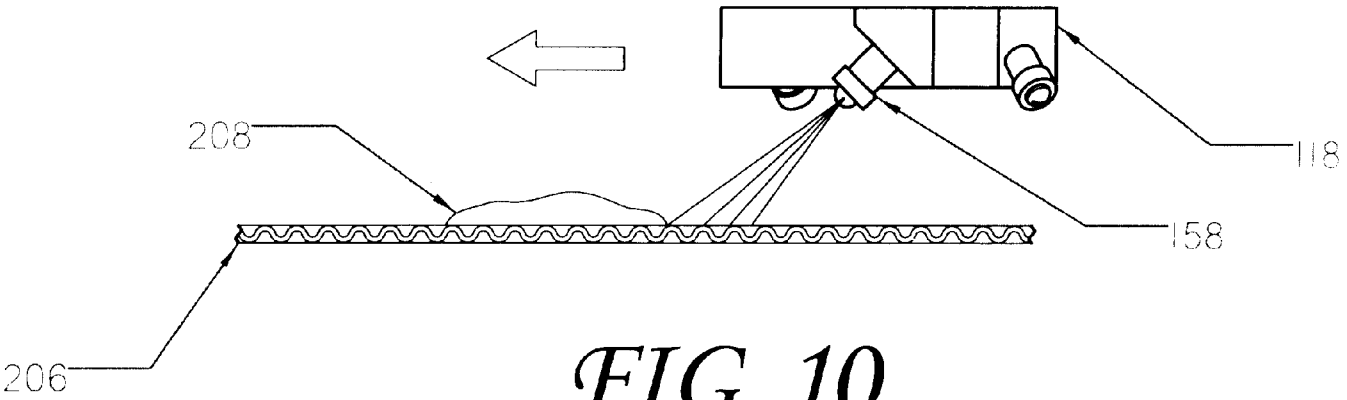
FIG. 10 illustrates the motion of the nozzle in the direction of the jet.
Figure 11:
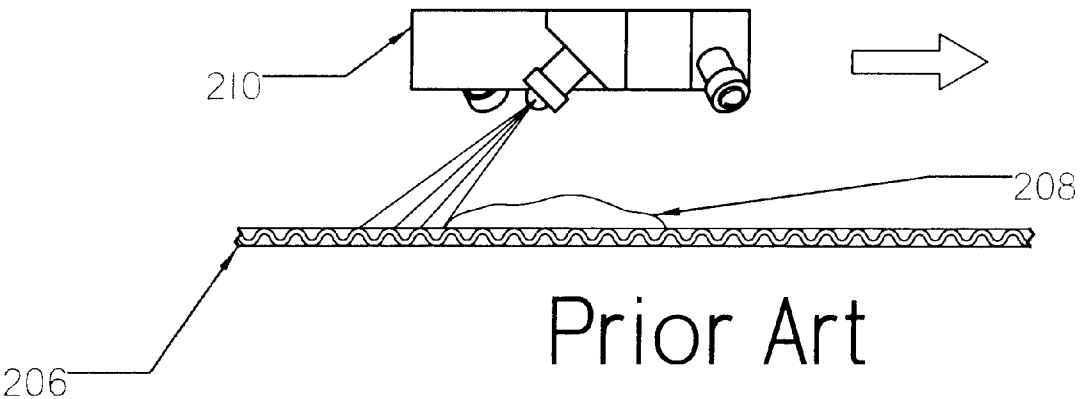
Prior Art FIG. 11
FIG. 11 illustrates the PRIOR ART motion of a nozzle away from the direction of the jet.

The use of rotating arms in cleaners which are driven by the force of the cleaning fluid ejected from the nozzles in known in the art. The present invention differs in that the arms and nozzles are mechanically driven, independently of the water pressure and direction. This offers significant benefits in the operation and performance of the unit, not the least of which is that the nozzles can be driven towards the direction of the jet rather than retreating from it, as shown in FIG. 10. This increases the effectiveness of the cleaning and can provide a lifting action as the cleaning fluid penetrates under the dirt. As the nozzles move in the direction of the cleaning fluid jet, the fluid first impacts dirt, 208, (especially caked on accumulations) at the lower edge, where it contacts the floor, 206. The high pressure of the fluid can then force the fluid between the dirt and the surface, separating and lifting the dirt. Where the surface is carpeted, the fluid can penetrate the pile of the carpet and lift the dirt from below. The typical prior art approach, shown in FIG. 11 causes the fluid jet to first impact the dirt on the upper surface rather than at the lower edge. The dirt is forced downward against the floor possibly causing it to adhere more firmly. While the preferred embodiment utilizes rotating heads on the ends of the arms, the above benefits can also be realized with fixed heads attached to the arms, where the arms are driven in the direction of the cleaning jet.

Figure 5:
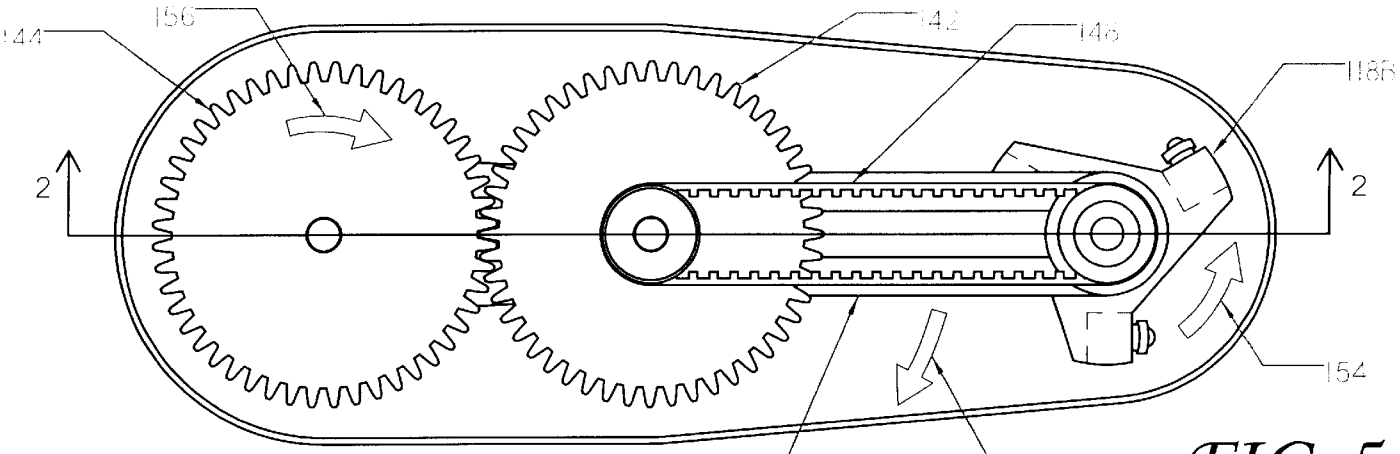
FIG. 5 is a top view of the arm and heads with the cover cut away to show the drive mechanism.
Figure 6:
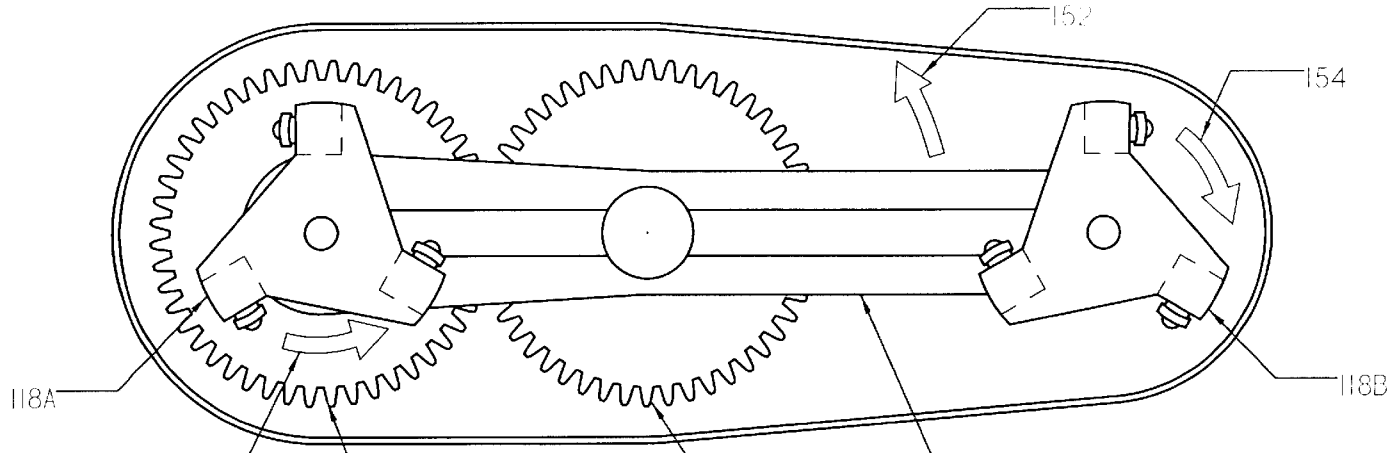
FIG. 6 is a bottom view of the arm and heads with the cover cut away to show the drive mechanism.
Figure 7:
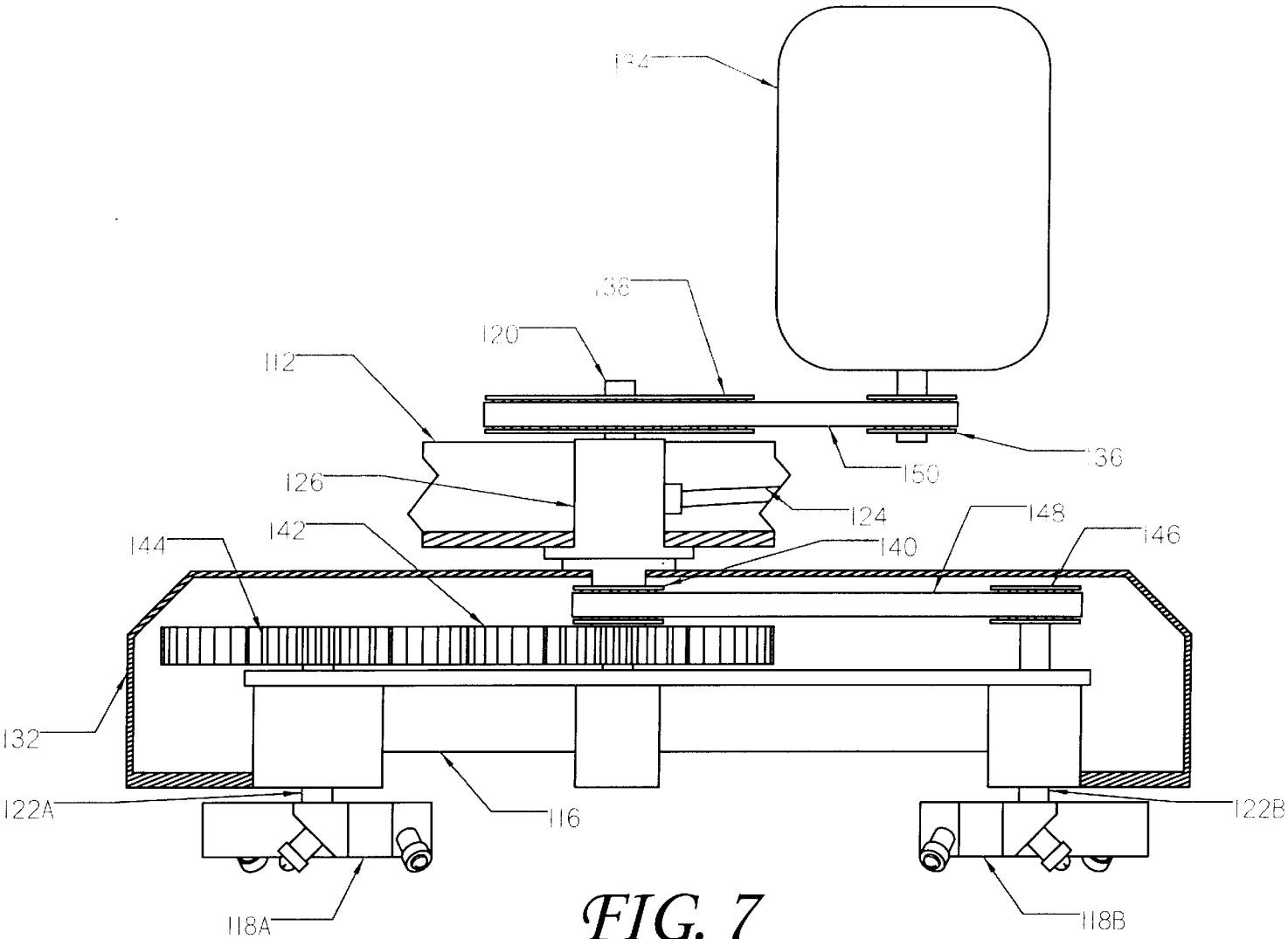
FIG. 7 is a side view of the arm, heads, and drive train with the cover cut away.

The drive train for the arm and heads can be seen clearly with reference to FIGS. 5–7. Motor, 134, drives the central shaft, 120, via pulleys, 136 and 138. In the preferred embodiment these are cogged to eliminate problems of slippage if the pulleys and belt become wet. Clearly non-cogged belts, chain drive, or other equivalent means could be used. Shaft, 120, in turn directly drives arm, 116, at the same rotational rate, causing it to spin about the shaft in the direction of arrow, 152. Pulley, 140, and gear, 142, are interconnected and fixed to the chassis, remaining stationary. As gear, 144, rotates around gear, 142, it rotates in the direction of arrow, 156. This rotary motion is transmitted to head, 118A, via shaft, 122A. Belt, 148, connects pulley, 140, to pulley, 146, causing it to rotate in direction of arrow, 154. Again, this rotary motion is transmitted to head, 118B, via shaft, 122B. The result of this combination of gear and belt drive for the two heads is that they rotate in opposite directions. As discussed below, this offers significant advantages in the operation and effectiveness of the unit. In the preferred embodiments the various gears and pulleys are selected so that the heads rotate at the same speed which is reduced from the speed of the motor. Clearly other combinations of gear and pulley ratios could be selected to provide other speeds and even to drive the heads at different speeds if desired.

There are at least two additional benefits of the above mechanical drive for the arm and heads. The first is in the selection of the rotational speeds for the arm and the heads. In prior art systems which are driven by the force of the cleaning fluid emitted from the nozzles, the speed of the arm and heads is directly related to the pressure of the fluid and the angle of the nozzles. Altering either characteristic will alter the rotational speeds. As such, the pressures and angles are compromises, optimal for neither the rotational speeds nor for cleaning of the surface. The present mechanical drive removes this dependency and allows the rotational speeds, fluid pressure, and nozzle angles to be selected independently. The speeds can be optimized for coverage, vibration, bearing life and other factors. Fluid pressure and nozzle angle can be optimized for cleaning. If desired both the motor speed and fluid pressure can be made variable and controllable by the user. Nozzle angle can also be varied either by adjusting the angle of the nozzles relative to the heads or by interchanging the heads. In the preferred embodiment, the nozzle angles are fixed relative to the head, and heads are interchanged to provide different angles. This provides stricter control of the angle, which is critical to the cleaning effectiveness and which should be matched to the surface (carpet, linoleum, asphalt, etc.) and condition (lightly soiled, grease caked, etc.). Additionally, different nozzles can be fitted to alter the fan angle at which the fluid is emitted from a narrow stream to a relatively wide fan. This further varies the impact of the fluid on the surface being cleaned. High pressure, combined with narrow fan angles, and/or slow rotational speeds allow the unit to physically remove heavy deposits of dirt or grease or even to strip finishes from certain surfaces. It is also possible to intermix the fan angles on the various nozzles to provide varied coverage. This can assist in avoiding striping, streaking, or other patterns which may be created by the regular pattern of identical jets passing over the surface.

A second benefit of the mechanical drive is that the rotational speeds remain constant as fluid pressure varies or is activated and deactivated. In prior art systems, the heads and arm would slow or even stop rotating when the fluid is switched off as it would at the end of a pass or to pause to move cords and hoses. After the fluid is switched back on, there is a delay as the arm and heads spin back up to operational speed. In the present invention, the rotational movement is independently controlled and can be maintained at a consistent speed throughout the operation of the unit.

Figure 9A:
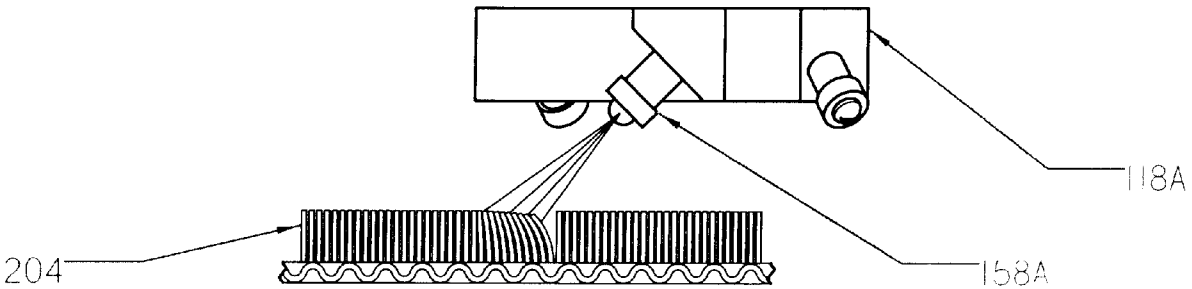
FIGS. 9A & B illustrate the alternating jet angles provided by the opposing rotation of the heads.
Figure 9B:
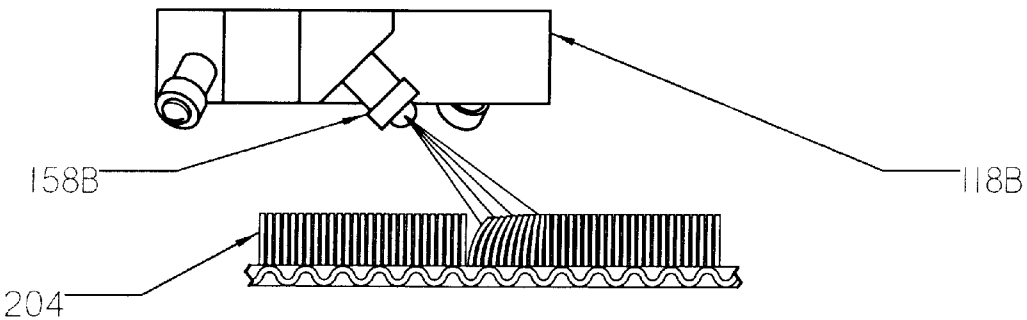

The characteristic of the heads rotating in opposite directions also provides a significant benefit. As shown in FIGS. 9A and 9B, as heads, 118A and 118B, pass over the same point on the surface, their nozzles, 158A and 158B, direct the cleaning fluid such that it impacts the surface, 204, (carpet illustrated) from opposite angles. In the preferred embodiment, the heads are configured so that these angles are symmetric about the vertical axis. Other combinations could clearly be used. As the heads pass over, the alternating jet angles provide a beating action to the surface. This is visible with carpet as the fibers are agitated, physically helping to loosen the dirt better than can a cleaner with a single angle. This beating is also effective on smoother surface where dirt, especially that which is caked on, is impacted from alternating directions, helping to loosen it.

Functionality

In use, the mobile unit is typically moved forward to the limit of the area to be cleaned and positioned at the end of an uncleaned strip of floor. The cleaning jets are then activated and the mobile unit is pulled backward at a steady pace until the opposite limit of the area is reached. The cleaning jets are deactivated shortly before the rearward motion is stopped to assure that the vacuum nozzles cover all of the area wetted by the jets. Typically the vacuum system and mechanical drive for the arm and heads remains active throughout the cleaning process. Alternatively, each could be activated and deactivate in a manner similar to that for the jets.

As the unit is pulled rearward, each section of floor which passes underneath is exposed to a series of cleaning jets as the arm and the nozzles rotate. The counter rotating motion of the heads results in cleaning fluid impacting the same spot on the floor from alternating directions, beating and loosening the dirt. The number of times which a particular spot is exposed to the jets depends on the rotational speeds of the arms and head and the linear speed of the mobile unit as it is pulled to the rear. All of these speeds can be varied, either by the user, or in the manufacturing process.

Alternative Embodiments

The preferred embodiment of the mobile unit utilizes a single vacuum pick up on the front of the unit. Alternatively, a second vacuum pickup can be added to the rear of the unit. This allows the unit to be used while moving forward. This increases the flexibility of the unit by allowing it to clean while moving in both directions. This can be used to eliminate the lost time as the unit is moved forward to the limit of the area to be cleaned. It also allows the unit to be operated in a manner analogous to a lawn mower, where it is moved forward continuously, and cleans continuously. While not a major advantage for cleaning interior floors, this feature becomes significant for cleaning sidewalks and parking lots as discussed below. If desired, a switch, or valve, could be provide to select either the front or the rear pickups, reducing the vacuum capacity which would be required if both were activated simultaneously. A further alternative is to automatically switch which nozzle is active depending on the direction of motion of the unit. The second vacuum nozzle could also be supplemented by a separate set of rinse nozzles analogous to those for the front nozzle. If desired, these rinse nozzles could be switched in tandem with the vacuum nozzles. Clearly, the unit could also be built with a single, rear vacuum pick up.

Another alternative is to fit the heads with brushes. These may either supplement or replace one or more heads. As a supplement, the brushes may be formed in a ring around the head, adapted so that the bristles contact the floor at, or outside of, the point that the cleaning jets impact the floor. As a replacement, one head can be replaced with a brush, while the other remains and functions as above. Either way, the brush would be driven by the same mechanism as the head and would supplement the cleaning action of the jets with a physical scrubbing action.

A further alternative is to reduce the size of the unit and make it portable. This portable unit could use a reduced size version of the above arm and nozzles, or could utilize a single head. With a reduced size arm, there would still be at least two counter rotating heads, Where a single head is used, it would be mechanically driven in the direction of the cleaning jets.

Applicability

The primary application for the present invention is for cleaning carpeted floors, as much of the prior art systems are used. However, the applicability of the system is much wider than that. The invention also shows significant benefit in cleaning hard surfaced floors. Because the rotational speeds of the arm and the heads are independent of the cleaning fluid pressure and jet angles, a wide variety of cleaning characteristics can be achieved. A combination of low pressure and relatively high rotational speeds provides rapid, low impact cleaning of lightly soiled surfaces. Conversely, a combination of high pressure and low rotational speeds, especially if combined with nozzles producing narrow fan angles, provides a cleaning system with a very high impact on the surface. Such a configuration is capable of removing heavy soil accumulations and even stripping certain types of finishes. Where combined with heated cleaning fluid and strong detergents or solvents, the system is even capable of cleaning driveways, parking lots, and sidewalks. The vacuum pickup provides for recovery of the contaminated fluid rather than allowing it to drain into the sewers. Where parking lots and driveways are being cleaned, the cleaning fluid is will likely be contaminated with substances such as oil, gas, and additives such as MTBE, which are hazardous and pose a significant threat to the environment if flushed into storm sewers or allowed to run off. The portable version is also applicable to counter tops, stairs, and other restricted access areas which would benefit from the cleaning capabilities provided by the present design.

While the preferred form of the invention has been disclosed above, alternative methods of practicing the invention are readily apparent to the skilled practitioner. The above description of the preferred embodiment is intended to be illustrative only and not to limit the scope of the invention.

We claim:

1. A surface cleaning apparatus comprising:

a) supply means for means for supplying pressurized cleaning fluid;

b) a chassis adapted to move over the surface;

c) plural arms, each of said arms:

i) rotatably supported relative to said chassis on an arm axis, and extending radially from said arm axis, said arm axis substantially perpendicular to the surface, ii) having proximal and distal ends, and iii) comprising a fluid channel for transferring fluid from said proximal end longitudinally along said arm;

d) fluid coupling means for transferring cleaning fluid from said supply means to said arms' fluid channels;

e) at least one head attached to each of said arms, each of said heads:

i) rotatably supported relative to said arm on an independent head axis, ii) comprising at least one fluid nozzle for emitting cleaning fluid onto the surface, said nozzle directed toward the surface at an inclined angle to the surface, and iii) comprising fluid transfer means connected to said nozzle and to said arm's fluid channel; and f) mechanical drive means:

i) comprising a motor drive supported by said chassis, ii) operatively connecting said motor drive to said arms whereby said arms are driven rotationally about said arm axis, iii) operatively connecting said motor drive to each of said heads whereby said head is driven rotationally about its head axis.

2. The cleaning apparatus of claim 1 wherein each of said head axes has a radial distance from said arm axis and at lease two of said radial distances are substantially different.

3. The cleaning apparatus of claim 1 wherein the rotational motion of said heads is such that said nozzles move generally in the direction of said inclined angle.

4. The cleaning apparatus of claim 3 wherein at least two of said heads rotate in opposing directions.

5. The cleaning apparatus of claim 4 wherein each of said head axes has a radial distance from said arm axis and at least two of said radial distances are substantially different.

6. The cleaning apparatus of claim 5 wherein each of said heads defines a coverage pattern as it moves and said two radial distances are sufficiently similar that said coverage patterns overlap substantially, whereby that portion of the surface in the overlapping area is subjected to cleaning fluid at alternating angles.

7. The cleaning apparatus of claim 1 wherein said motor drive comprises a variable speed control.

8. The cleaning apparatus of claim 1 wherein said cleaning fluid supply means comprises a variable fluid pressure control.

9. The cleaning apparatus of claim 1 further comprising a vacuum nozzle, supported by said chassis, coupled to a vacuum pump, and adapted to be in close proximity to the surface, whereby said vacuum nozzle extracts cleaning fluid emitted by said nozzles.

10. The cleaning apparatus of claim 9 further comprising a second vacuum nozzle coupled to said vacuum source and wherein said chassis is adapted to travel in a substantially linear direction, said first and second vacuum nozzles being opposed by 180 degrees relative to said arm axis and positioned so that one precedes said arms and one follows said arms as said chassis moves linearly.

11. The cleaning apparatus of claim 10 further comprising means to select between said first and second vacuum nozzles for coupling to said vacuum source.

12. The cleaning apparatus of claim 11 wherein said means to select automatically selects one of said vacuum nozzles based on the relative direction of movement of said chassis.

13. The cleaning apparatus of claim 11 wherein said means to select automatically selects one of said vacuum nozzles and one set of said rinse nozzles based on the relative direction of movement of said chassis.

14. The cleaning apparatus of claim 10 further comprising a first and second set of rinse nozzles, said first set adapted to emit fluid adjacent said first vacuum nozzle between said first vacuum nozzle and said arms, said second set adapted to emit fluid adjacent said second vacuum nozzle between said second vacuum nozzle and said arms.

15. The cleaning apparatus of claim 14 further comprising means to select between said first and second vacuum nozzles for coupling to said vacuum source and between said first and second set of rinse nozzles for emitting fluid.

16. A surface cleaning apparatus comprising:

a) supply means for means for supplying pressurized cleaning fluid;

b) a chassis adapted to move over the surface;

c) plural arms, each of said arms:

i) rotatably supported relative to said chassis on an arm axis, and extending radially from said arm axis, said arm axis substantially perpendicular to the surface, ii) having proximal and distal ends, and iii) comprising a fluid channel for transferring fluid from said proximal end longitudinally along said arm;

d) fluid coupling means for transferring cleaning fluid from said supply means to said arms' fluid channels;

e) at least one head attached to each of said arms, each of said heads:

i) rotatably supported relative to said arm on an independent head axis, ii) comprising at least one fluid nozzle for emitting cleaning fluid onto the surface, said nozzle directed toward the surface at an inclined angle to the surface, and iii) comprising fluid transfer means connected to said nozzle and to said arm's fluid channel;

wherein at least two of said heads rotate in opposing directions;

f) mechanical drive means:

i) comprising a motor drive supported by said chassis, ii) operatively connecting said motor drive to said arms whereby said arms are driven rotationally about said arm axis, iii) operatively connecting said motor drive to each of said heads whereby said head is driven rotationally about its head axis; and g) a vacuum nozzle, supported by said chassis, coupled to a vacuum pump, and adapted to be in close proximity to the surface, whereby said vacuum nozzle draws up cleaning fluid emitted by said nozzles.

17. The cleaning apparatus of claim 16 wherein each of said head axes has a radial distance from said arm axis and each of said heads defines a coverage pattern as it moves and wherein at least two of said radial distances are sufficiently different that said coverage patterns overlap by no more than 90 percent and said two radial distances are sufficiently similar that said coverage patterns overlap by no less than 10 percent, whereby that portion of the surface in the overlapping area is subjected to cleaning fluid at alternating angles.

18. The cleaning apparatus of claim 17 further comprising a second vacuum nozzle coupled to said vacuum source and wherein said chassis is adapted to travel in a substantially linear direction, said first and second vacuum nozzles being opposed by 180 degrees relative to said arm axis and positioned so that one precedes said arms and one follows said arms as said chassis moves linearly and means to select between said first and second vacuum nozzles for coupling to said vacuum source.

19. The cleaning apparatus of claim 18 wherein said means to select automatically selects one of said vacuum nozzles based on the relative direction of movement of said chassis.

20. The cleaning apparatus of claim 19 further comprising a first and second set of rinse nozzles, said first set adapted to emit fluid adjacent said first vacuum nozzle between said first vacuum nozzle and said arms, said second set adapted to emit fluid adjacent said second vacuum nozzle between said second vacuum nozzle and said arms and wherein said means to select also selects between said first and second set of rinse nozzles for emitting fluid.

* * * * *